US006000084A

United States Patent [19]

Briscoe

[11] Patent Number: 6,000,084

[45] Date of Patent: Dec. 14, 1999

[54] SURFACE WORKING APPARATUS

[76] Inventor: William Anthony Briscoe, Wades House, Winchester, Hampshire, United Kingdom

[21] Appl. No.: 08/820,389

[22] Filed: Mar. 12, 1997

[30] Foreign Application Priority Data

Sep. 4, 1996 [GB] United Kingdom ..... 9618419.7
Feb. 20, 1997 [GB] United Kingdom ..... 9703528.1

[51] Int. Cl.[6] ..... A47L 11/16; A47L 11/24

[52] U.S. Cl. ..... 15/49.1; 15/87; 15/98; 451/353

[58] Field of Search ..... 15/49.1, 50.1, 15/50.2, 52.2, 87, 98; 451/353

[56] References Cited

U.S. PATENT DOCUMENTS

| | | | |
|---|---|---|---|
| 1,000,696 | 8/1911 | Schlueter | 15/49.1 |
| 1,139,407 | 5/1915 | Finnell | 15/49.1 |
| 1,581,687 | 4/1926 | Pape | 15/49.1 |
| 3,496,681 | 2/1970 | Oswald | 15/49.1 |
| 4,041,567 | 8/1977 | Burgoon | 15/50.1 |
| 4,218,798 | 8/1980 | Block | 15/49.1 |
| 4,674,142 | 6/1987 | Meili | 15/49.1 |
| 4,757,566 | 7/1988 | Field | 15/49.1 |
| 4,910,824 | 3/1990 | Nagayama | 15/49.1 |
| 5,016,310 | 5/1991 | Geyer | 15/49.1 |
| 5,615,437 | 4/1997 | Takahashi | 15/49.1 |

*Primary Examiner*—Randall E. Chin
*Attorney, Agent, or Firm*—Young & Thompson

[57] ABSTRACT

A combined floor scrubbing/floor burnishing apparatus comprises a machine frame (16) supporting a motor-driven surface-working head arrangement (27), a device (10) for selectively varying the pressure exerted by the head arrangement on the surface, and a unit means (40) for selectively varying the speed at which the head arrangement is driven by the motor so that the higher operational speeds required of the surface-working head arrangement can be readily achieved at the reburied lower application pressures and vice versa.

18 Claims, 13 Drawing Sheets

U8B
5
6
7
+
-
D17
R22
R35
R29
R31
C18
C14
R27
C11
C13
R24
D16
R6
R23
BRUSH
RL2
D4
Q5
DOWN
RL4
D6
UP
RL3
D5
P5

SURFACE WORKING APPARATUS

FIELD OF THE INVENTION

The present invention relates to surface working apparatus and in particular, but not exclusively, to apparatus for burnishing, or otherwise polishing a surface, or for scrubbing, sweeping or otherwise cleaning a surface.

BACKGROUND OF THE INVENTION

In referring to apparatus for working a surface, it should be understood that the present invention relates to apparatus for improving the appearance of a surface, for example by cleaning or polishing the surface. Examples of surface working apparatus comprise cleaning or sweeping machines particularly adapted for use in the cleaning or sweeping of the floor space of commercial/industrial premises, such as supermarket floors or transport terminal concourses. Such machines may be so-called pedestrian operated in that they are controlled by a pedestrian operator who controls movement of the machine across the floor surface or, alternatively, such known machines may comprise so-called ride-on machines which support the operator during the cleaning process.

Such known machines further traditionally comprise surface-working head arrangements comprising rotating brush heads which are biased into contact with the surface to be cleaned at a particular pressure which may be dependent upon the nature of the surface being cleaned.

Known apparatus of this type is disclosed in UK Patent Applications 9518230.9, GB 2,283,905A and GB 2,290,021A, the contents of which are incorporated herein by reference.

Such known apparatus exhibits advantages over previous systems in that the pressure at which the brushes are biased towards the surface being cleaned can be accurately controlled and varied over a relatively wide range and, in particular, towards the lower pressure end of the range.

However, the mode of operation such known apparatus still somewhat restricts the purposes for which the apparatus can be used since the apparatus is restricted merely to surface-cleaning activities and so if further surface-cleaning activities are required, either on the surface cleaned, or upon a completely different surface, it becomes necessary to use a separate surface-working machine adapted for that particular surface.

OBJECT OF THE INVENTION

The present invention seeks to provide for surface working apparatus which does not exhibit the aforementioned restrictions, and other disadvantages, found in the prior art.

SUMMARY OF THE INVENTION

According to the present invention there is provided surface working apparatus comprising a machine frame supporting a motor-driven surface-working head arrangement, means for selectively varying the pressure exerted by said head arrangement on said surface, and means for selectively varying the speed at which said head arrangement is driven by said motor.

In providing for a selectively variable speed control of the head arrangement in addition to a selectively variable pressure control, the apparatus of the present invention is particularly advantageous in that it can be used for a variety of surface-working operations which can include scrubbing and burnishing. Floor scrubbing traditionally requires operation of the surface-working heads, i.e. cleaning heads, at a relatively high pressure and low rotational speed, whereas floor-burnishing traditionally requires application of the surface-working heads at relatively high speeds but low pressures.

Preferably, the surface-working head arrangement is adapted for the releasable mounting of a variety of surface-working elements such as scrubbing brushes as commonly found on floor-cleaning apparatus and burnishing brushes or pads etc. as commonly found on floor-burnishing apparatus.

It will therefore be appreciated that one of the same apparatus can advantageously be used for a wide variety of floor-working activities.

In such a manner, the surface-working head arrangement is arranged for releasable mounting of a plurality of surface-working members each having different surface-working characteristics.

Preferably the means for selectively varying the pressure exerted by the surface-working head is arranged to alter said pressure in response to use of said surface working head means exhibiting different working characteristics.

Also, said means for selectively varying the speed at which said head arrangement is driven by said motor is arranged such that said speed can be altered in response to use of said surface-working head means exhibiting different characteristics.

As will be appreciated from the above, two examples of such different characteristics may comprise those exhibited by a surface-cleaning means, for example a scrubbing brush, exerted by a surface-polishing means, such as a burnishing head or buffing head.

Advantageously, the apparatus includes an actuator arrangement comprising spring means mounted to act as suspension means including means for biasing the surface-working head arrangement towards a surface to be worked, tensioning means for tensioning the spring means so as to set the pressure of the surface-working head arrangement and wherein the spring means is selectively adjustable wire tensioning means over a continuous range to provide a required bias towards the surface.

Also, the apparatus can advantageously include biasing means acting between the frame and the surface-working head arrangement to apply to the surface-working head arrangement a selectable bias towards the surface to be worked and mounted to act as suspension means between the frame and the surface-working head arrangement, means for monitoring and/or measuring the applied working pressure, means for displaying an indication of the measured working pressure, means for operator entry of a desired working pressure for the surface-working head arrangement and comparator means for comparing the operator input pressure to the measured pressure and for generating a control signal in response to the difference between the desired pressure and the measured pressure and means for applying the control signal to the pressure applying means.

Preferably said means for selectively varying the pressure applied to the surface by said surface-working head arrangement comprises biasing means acting between the frame and said surface-working head arrangement: and comprising an actuator having a first member, and a second member extendible therefrom and which actuator is further preferably operable manually, hydraulically or electrically.

The biasing means may preferably comprise a spring means which may further include at least one spring device acting between a portion of the actuator and the surface-working head arrangement.

In particular, the spring device may comprise a sleeve secured to said portion of said actuator means, a rod having an inner end slidable within the sleeve, the rod projecting from the sleeve to the surface-working head arrangement, and a spring located within the sleeve engaging the inner end of the rod.

Preferably, the apparatus includes an actuator arrangement for raising and lowering the surface-working head arrangement and mounted between the frame and the surface-working head arrangement, and means operatively connected to the surface-working head arrangement and arranged to at least partially counteract the force to be exerted on the surface by way of the surface-working head arrangement and so as to control the pressure applied to the surface by the surface-working head arrangement to a range including zero pressure to a pressure corresponding to the weight of the surface-working head arrangement.

Advantageously, the means for at least partially counteracting is arranged to balance the weight of the surface-working head arrangement prior to activation of the actuator means. The actuator means can then advantageously move the surface-working head arrangement towards the surface to be worked to achieve the required pressure within the aforementioned range.

Advantageously, the means for counteracting the force exerted on the surface-working head arrangement by the actuator comprises counterbalancing means and, further the said means can advantageously comprise resilient means.

In particular, the resilient means can be provided in the form of at least two relatively movable members which are arranged to be relatively movable in a resilient manner.

Preferably, the resilient means can then comprise a cylinder/piston arrangement which can advantageously comprise a gas strut arrangement.

Also, the resilient means can advantageously be provided in the form of one or more spring members.

Further, the means for selectively varying the pressure exerted by the surface-working head arrangement may comprise an elongate balance beam pivotally connected to the frame and connected at one end to the actuator for movement therewith, and at the other end having a counter balance mounted thereon.

In particular, the counter balance may have a mass which is arranged to be substantially equivalent to the mass of the surface-working head arrangement.

The aforementioned balance arrangement is particularly advantageous in providing for an accurately controllable pressure arrangement towards the low-pressured end of the possible pressure spectrum.

The aforementioned means serving to counteract the force exerted onto the surface to be worked through the actuator member and the surface-working head arrangement advantageously assists in accurately determining a net pressure to be applied to the surface to be worked particularly in a range between zero and the weight of the surface-working head arrangement. This is particularly useful in the present invention since it enhances the variety of cleaning modes which can be adopted by the apparatus of the present invention.

Advantageously, the relatively variable pressure control system further comprises a linkage connecting the frame to the surface-working head arrangement in such a manner that the head arrangement is substantially horizontally supported. In particular, the aforementioned linkage may be in a form of a parallelogram linkage.

The apparatus further advantageously comprises means for determining operational characteristics of the surface-working head means such as those relating to the state of the head means and/or the actual pressure applied to the surface so that said data can be used in the subsequent control of the apparatus.

Preferably, said apparatus further includes means for monitoring and/or measuring the pressure applied, input means operable for an operator to select a desired pressure, comparator means for comparing the design pressure with the desired pressure and for generating a control signal in response to the comparison result and means for applying the control signal to control the pressure applying means.

Advantageously the feed-back provided by said control means is arranged to generate a control signal for the brush pressure dependent further on an operator input desired pressure and wherein comparator means are provided to compare the measured pressure with the desired pressure.

Preferably, the comparator comprises an electronic processor and, further, the displaying means can be adapted to display a digital value of the applied pressure.

The pressure measuring means many comprise any one of a strain gauge, a pressure transducer or a piezoelectric sensor. Further, the apparatus may comprise analogue to digital conversion means for converting input signals representing respectively a measured working-head pressure and an operator-chosen pressure, storage means for determining system operational parameters, and computing means programed to compare the two input signals and to generate a control signal in response to the comparison and the pre-determined operations parameters.

As will therefore be appreciated from the aforementioned features, means for selectively varying the pressure exerted by said head arrangement on said surface is arranged to provide for an accurate determination of the pressure applied, particularly at the lower end of the possible pressure values, so that, in combination with the selectively variable speed at which the head arrangement can be driven by the motor, the apparatus provides for an advantageously wide variety of surface-working activities.

The means for selectively varying the speed at which the head arrangement is driven by said motor advantageously comprises a selective plurality of gear arrangements having gear ratios determined on the basis of the working operations required.

Preferably, said selectively switchable gearing is located in a gearbox arrangement between the motor and the surface-working head arrangement.

The gearing arrangement preferably comprises respective pairs of gears in constant mesh and means for selecting one of said pairs for delivering the upward drive from said gearbox.

Advantageously, the means for selecting said one of said pairs comprises clutch means which may advantageously be in the form of dog-clutch means. Such dog-clutch means can prove particularly advantageous when two pairs of gears are provided within the gearbox.

Control means are provided for effecting movement of the clutch arrangement and such control means may comprise a solenoid actuator which can be retained in its two or more possible operative positions by locking means such as solenoid locking means.

The means for controlling switching in the gearbox is advantageously associated with the means for selecting the pressure applied by way of the surface-working head arrangement so that the switching of the gearbox is achieved in response to the selection of particular pressure values either above or below one or more threshold values or the selection of specific values, or alternatively, the control arrangement can be such that the selection of any particular pressure value or range is responsive to switching of the gearbox.

Thus, it will be appreciated that the means for selectively varying the pressure exerted by the surface-working head arrangement can be operated in response to the selection of the speed at which the head arrangement is to be driven by the motor or, conversely, the speed at which the head arrangement is to be driven by the motor is altered in response to the selection of a particular pressure value, or range, at which the head-arrangement is to operate.

With regard to a particular feature of the present invention, i.e. when the apparatus is arranged both for surface scrubbing and surface burnishing operations, the higher operational speeds required of the surface-working head can readily be achieved at lower pressures of application of the surface-working head member to the surface and, conversely, lower operational speeds can be arranged to be achieved at higher pressures. This is particularly advantageous for the aforementioned surface-working processes since surface scrubbing is commonly conducted at high pressure, for example 200 lbs, and low speed, for example 200 rpm, values whereas surface burnishing is commonly conducted at lower pressure, for example 30 lbs, and higher speeds, for example 1,000 rpm.

To achieve the operation at specific values such as those mentioned above, the gearing arrangement advantageously comprises a first gear pair with a 1:1 ratio and a second gear pair with a 5:1 ratio so that the aforementioned speeds can be readily achieved.

Advantageously, control means are provided which serve to inhibit the change in gearing while the motor is driving the surface head arrangement.

Further, the control means advantageously places an upper limit on the pressure that can be applied by way of the surface-working head arrangement once the high-speed gear ratio is selected.

Further control means can advantageously be provided so as to inhibit operational characteristics associated with use of one or more of the particular surface-working members. For example valve means can be provided so as to inhibit water supply to the surface-working head arrangement when the apparatus is selected for providing a burnishing operation.

It will therefore be appreciated that the present invention advantageously provides for a combined floor scrubber/burnisher machine.

BRIEF DESCRIPTION OF THE DRAWINGS

The present invention is described hereinafter, by way of example only, with reference to the accompanying drawings in which.

DESCRIPTION OF THE PREFERRED EMBODIMENTS

Figure 1:
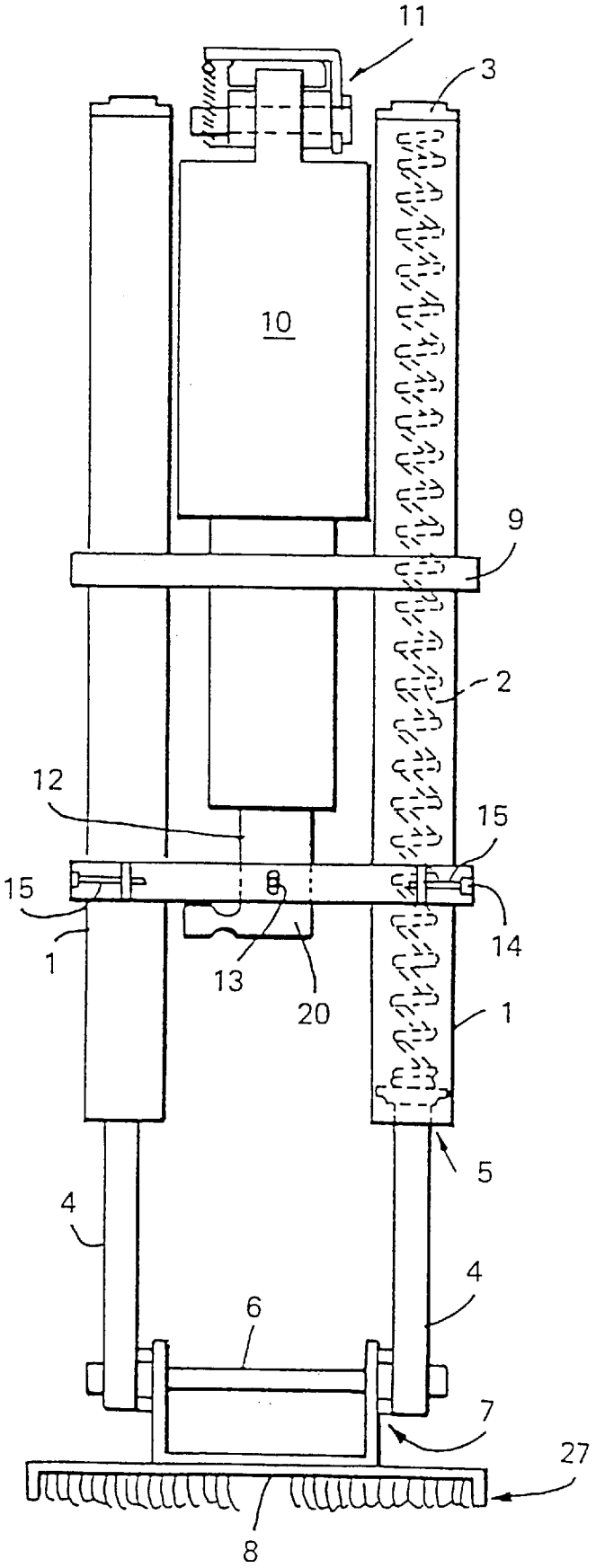
FIG. 1 show a cross-section elevational view of a brush assembly for a surface cleaning/sweeping/burnishing machine in front view.

In FIG. 1 the brush assembly comprises two spring tubes 1 containing springs 2. The right hand tube 1 in the Figure is shown in cut-away to illustrate spring 2. Each spring is fixed at one end to the upper end of the tubes at 3 and at the other end to a spring rod 4 which slides through an aperture 5 into she respective spring tube 1.

The spring rods 4 are connected together by a bolt 6 and are fixed via assembly 7 to the brush support plate 8 to which brush head or heads 27 are connected. The brush heads 27 are releasably secured to the assembly so as to allow for ready replacement by burnishing heads, or other heads, as required.

The tubes 1 are prevented from rotating or skewing by a steadying plate 9. An actuator 10 is secured to a bulkhead of a cleaning machine. Actuator 10 drives actuator rod 12 which is shown in substantially closed up position in the Figure. The actuator rod 12 is fixed by a pin 13 to actuator plate 14 which is clamped to both spring tubes 1 by clamping bolts 15. Thus as the actuator drives the actuator rod 12 downwards, the spring tubes 1 move downwards and the springs 2 are compressed causing a higher pressure to be exerted on the brush head assembly whilst still providing suspension to accommodate uneven floors and brush wear. Typically, the effective spring lengths, in an uncompressed state, are around 15 inches and this is particularly suitable for a 26/32 inch brush pressure system. Such an arrangement can provide a range of 0 to 450 lb pressure in a loaded pedestrian cleaning machine fitted with apparatus according to the invention, compared Lo the maximum 200 lb pressure available using known apparatus. Of course other forms of biasing means could be used. A torsion spring has the advantage of taking up less vertical space in a cleaning machine. Also, a torsion spring generally has a low spring rate which is particularly suitable for this purpose. Gas struts or hydraulic or pneumatic systems could also be used.

The pressure can be further adjusted by changing the springs for different length ones or different strengths the clamping position of the spring tubes can be altered. However these changes require a service engineer.

The system is particularly adjustable since the actuator can be stopped anywhere in its stroke.

Usually brush support plate 8 will be attached to a pair of circular or elliptical brushes rotating in a plane generally parallel to the floor (or surface to be cleaned or swept or scrubbed). However, up to four brushes are in use in some cleaning machines and the apparatus of the invention could be used to control all such four brushes together or alternatively individually (in which case separate actuators would be used for each). Of course a cylindrical brush head could equally easily be controlled mounted on the brush support plate 8 or alternatively controlled at each end of its shaft by respective separate assemblies according to FIG. 1.

A strain gauged beam 20 which may be used to measure the brush pressure is located under the spring tube clamp plate 18.

Figure 2:
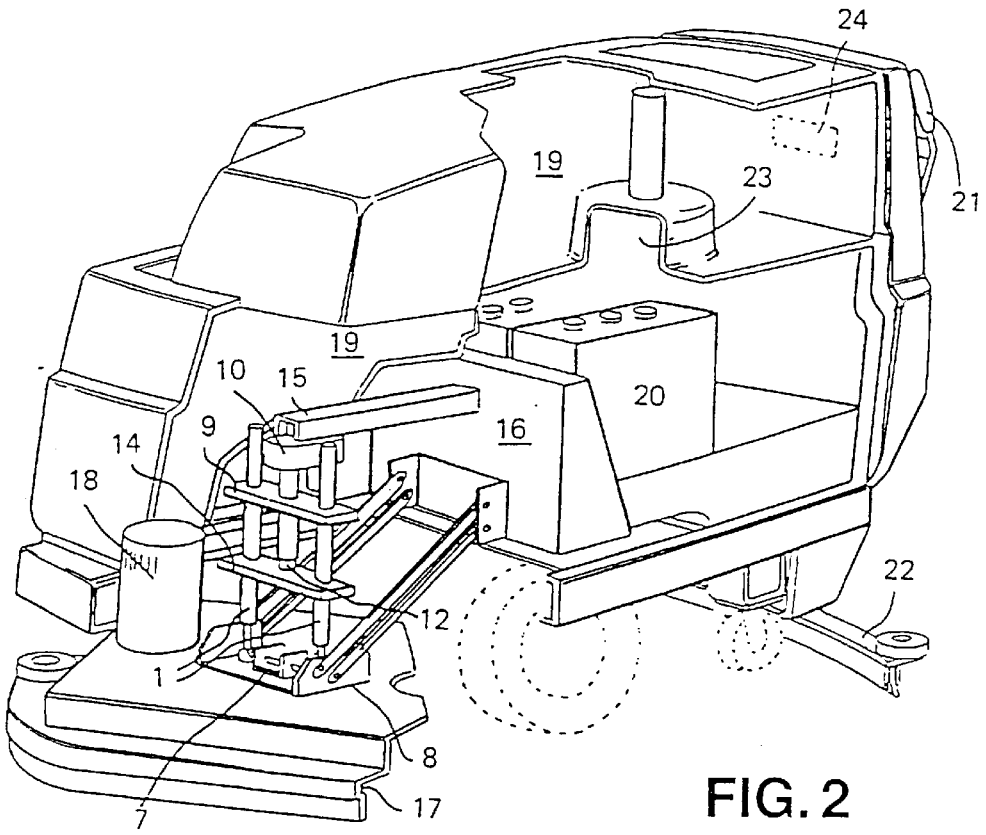
FIG. 2 is a perspective view of a machine adopting the brush assembly of FIG. 1.

In FIG. 2 the brush assembly of FIG. 1 is shown mounted in a pedestrian cleaning apparatus. Like parts are indicated by like reference numerals and a pair of spring tubes 1 are attached to actuator rod 12 by actuator plate 14. The actuator 10 is fixed by tie bar 15 to the apparatus frame 16. A second pivoted mounting 17 connects the assembly 7 and brush support plate 8 to frame 16. The brushes themselves are not shown in FIG. 2 but are mounted below the support plate 8 behind the protective flange 17 and are driven by scrub brush motors 18 (one of which is shown in FIG. 2).

FIG. 2 also illustrates the relative positions of the water tank or tanks 19, the batter pack 20 for driving the scrub motors 18 together with the transverse drive of the cleaning apparatus. The direction of transverse drive is controlled by a handle 21. A squeegee 22 has suction applied via vacuum motor 23.

Additionally a brush head pressure control panel 24 is provided within the operator's view.

Figure 3:
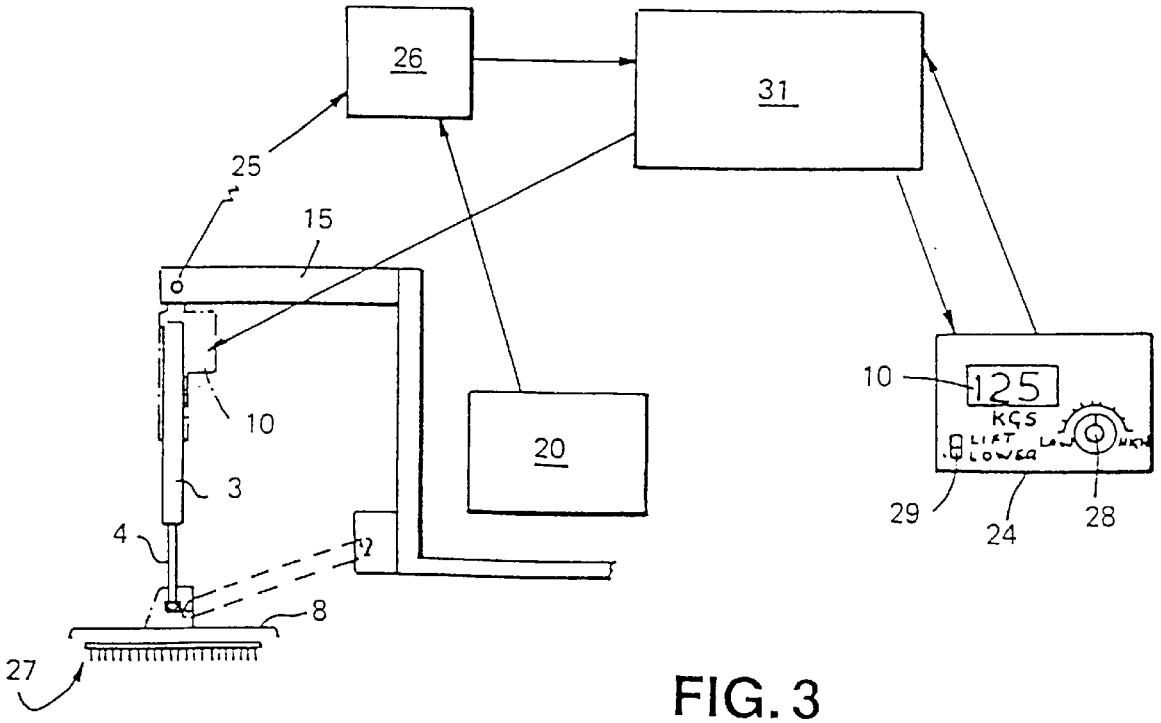
FIG. 3 is a diagrammatic presentation of a control for the apparatus of FIGS. 1 and 2.

In FIG. 3 the brush assembly is shown schematically in side view and a control system is illustrated as a block diagram.

The position of the brush head 27 relative to the floor to be cleaned, is controlled by electric or hydraulic actuator 10 lifting or lowering the brush head via an actuator rod which compresses springs in spring tube 1. Other resilient means such as a gas strut may be used for applying pressure to the brush head against the floor and of course other means may be used to control the position of the brush head such as hydraulic or pneumatic means. Details of the actuator 10 has been described above.

A pressure sensor is located at one of the positions labelled 4 though it may be positioned anywhere in the cylinder or in the arm or in the bottom of the actuator. In use this sensor monitors the pressure applied by the brush to the floor and generates a signal 25. The pressure sensor may be a strain gauge 20 on actuator plate 14 as shown in FIG. 1 or a piezoelectric sensor or position sensor. Alternatively the secure pin (11 in FIG. 1) which connects the assembly to the apparatus frame, may be used as a shear gauge to measure pressure. Amplifier 26 converts this pressure signal 25 to a value usable in the subsequent circuitry.

The control panel 24 is provided within sight of an operator. It has a pressure select knob 28 by which the operator can pre-select a particular pressure. A rocker switch 29 lifts or lowers the brush head 27 relative to the floor depending on the switch position. A digital display 30 illustrates the pressure of the brush head 27 on the floor, as measured boar the pressure sensor.

A processor 31 compares the measured pressure signal with the operator selected pressure and generates a control signal accordingly to control (as necessary) the actuator to make the measured pressure substantially the same as the selected pressure.

This processor may, be of simple construction such as comprising an electronic (comparator and amplifier circuit, or it may comprise a standard CPU unit in chip form.

Power for the electronic components is supplied by the on-board battery 12 or by alternative low power battery sources.

Figure 4:
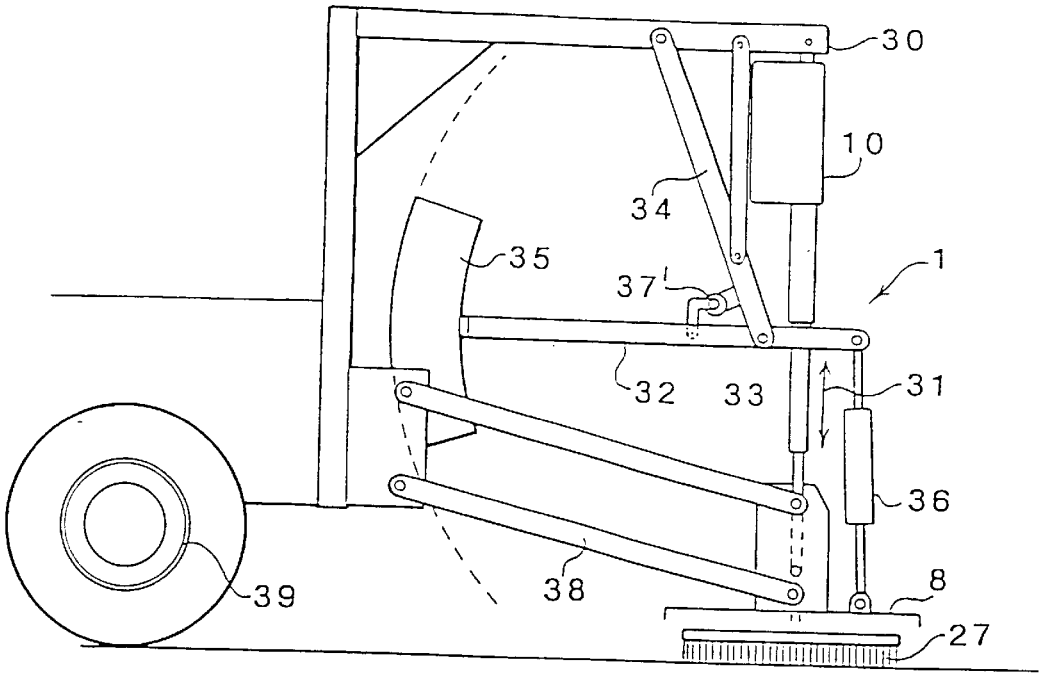
FIG. 4 is a side view of the brush/pad pressure assembly of FIG. 1 showing a control system, according to one embodiment of the present invention.

FIG. 4 shows the brush head with planetary brushes for scrubbing, cleaning, polishing or sweeping a floor surface mounted via the actuator 10 (only one arm of which is shown) to the machine frame, specifically to the actuator support bracket 30.

The brush head is raised and lowered as indicated by arrow 31 by a screw jack-mounted on the actuator 10.

The motors for driving the brushes are mounted on the brush head but not shown in FIG. 3. The water tanks for the machine, mounted on the frame, or chassis are also omitted in FIG. 3 to more clearly show the other parts of the device.

A balance beam 32 is mounted by pivot bearing 33 to one end of a pivot support 34, the other end of which is connected to the frame. The beam 32 is also connected to actuator arm 1 and on the other side of the pivot bearing 33 to a counterweight 35 corresponding to the weight of the brush head. The opposite end of beam 32 is linked to the brush head by a turnbuckle linkage adjuster 36, which is used to adjust the counterbalance for brushes of different length, for example to prevent jamming of the brushes against the floor.

A potentiometer 371 for measuring brush wear is connected between the balance beam 32 and the pivot support 34.

Further support for the brush head is provided by a parallelogram linkage 38 between the brush head and the side of the main frame to keep the brush deck positioned.

A drive wheel 39 for the machine is shown: usually one such wheel is positioned at each corner of the chassis or frame.

The path of movement of the counterweight is shown in dotted outline, as the brushes are raised by the lower line and as they are lowered by the upper line. As the brushes are lowered to the floor by the actuator 10 the balance beam 32 rotates about pivot bearing 33 and the counterweight 35 swings upwardly. The change in position of the balance beam 32 causes a corresponding change in the position of the wiper of the potentiometer and 37 thus the measured resistance changes. A load sensor (not shown in FIG. 4) detects the position at which the brushes touch the floor, i.e. a positive pressure is registered and pauses the actuator momentarily for the potentiometer measurement at that position to be recorded. The actuator then continues to drive the brush head down onto the floor until the desired pressure on the floor is attained.

The counterweight counteracts the weight of the brush head and allows a very low range of brush pressures to be selected, much lower than was hitherto attainable, for example less than 1 lbs. This range is used for light cleaning or polishing or for cleaning fragile or specialist floor surfaces.

Comparison of readings on the potentiometer as the brushes contact the floor is a measure of the amount of wear on the brushes and can be used to provide an indication of such on a display panel of the operator's console.

This example is of course only one of many possible embodiments of the invention. It will readily be understood by a person skilled in the art that this system is applicable to cleaning, sweeping, polishing and scrubbing machines of a wide variety of types and could be used on machines needing to apply pressure not only downwards but upwards, and sidewards too with suitable modifications which are within the non-inventive capabilities of a person skilled in the art. The operation within a wide range of pressures can be advantageously employed in accordance with the present invention.

Figure 5:
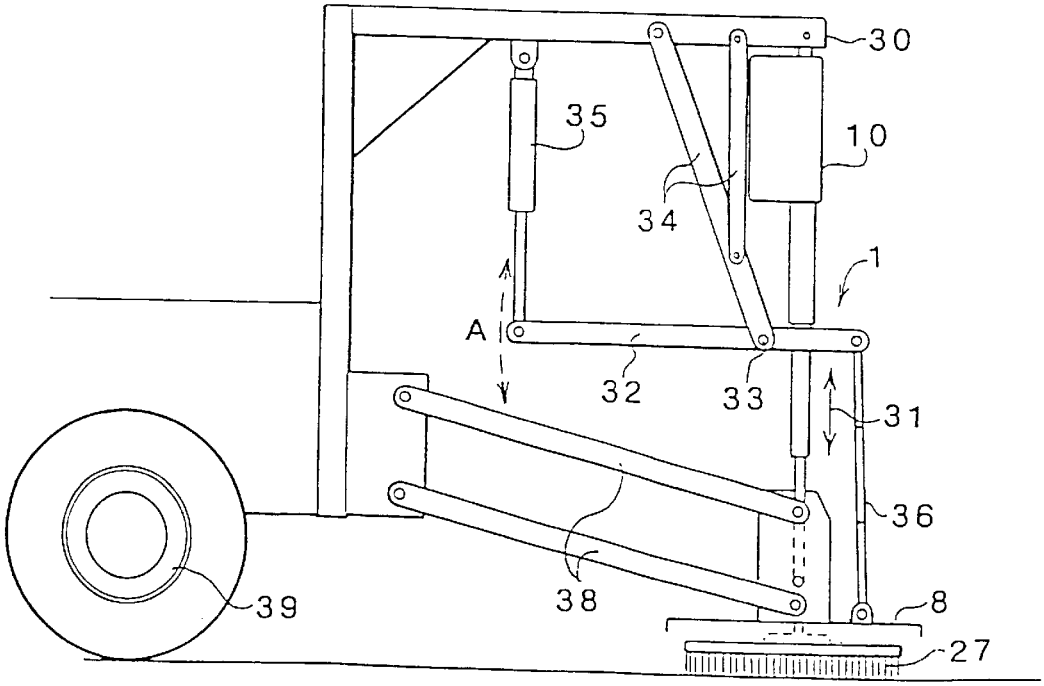
FIG. 5 is a side view of the brush pressure assembly of FIG. 1 showing the control system of the present invention.
Figure 6:
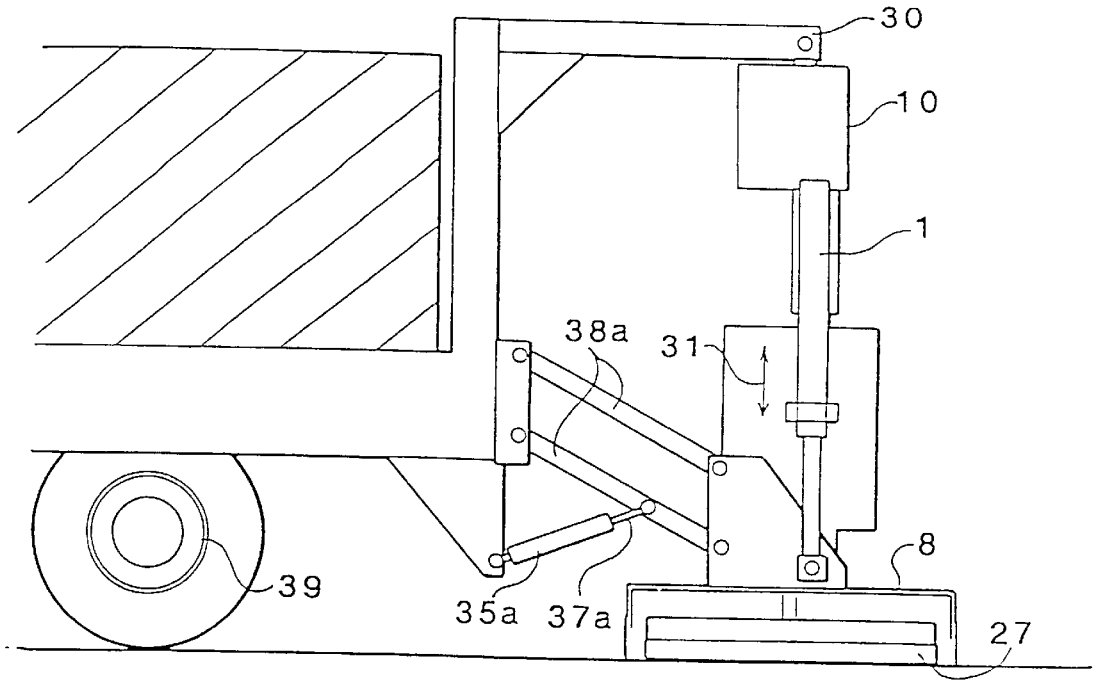
FIG. 6 is a view a brush pressure assembly according to another embodiment of the invention.
Figure 7:
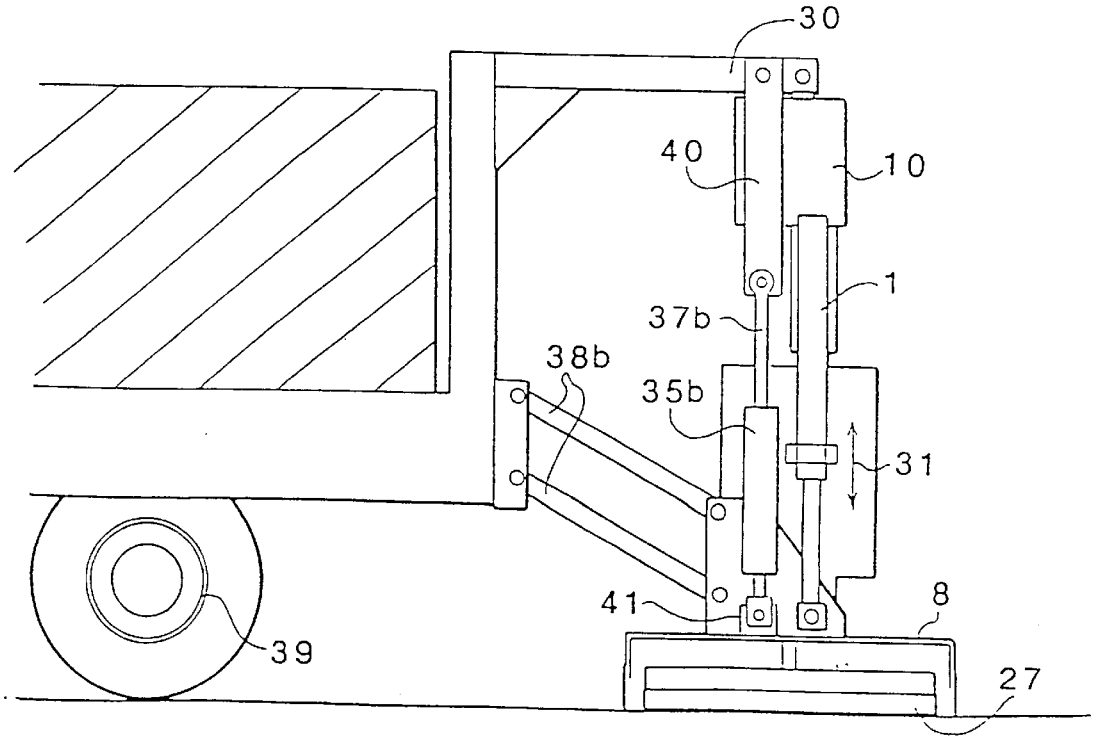
FIG. 7 is a side view of a brush pressure assembly according to yet another embodiment of the present invention.
Figure 8A:
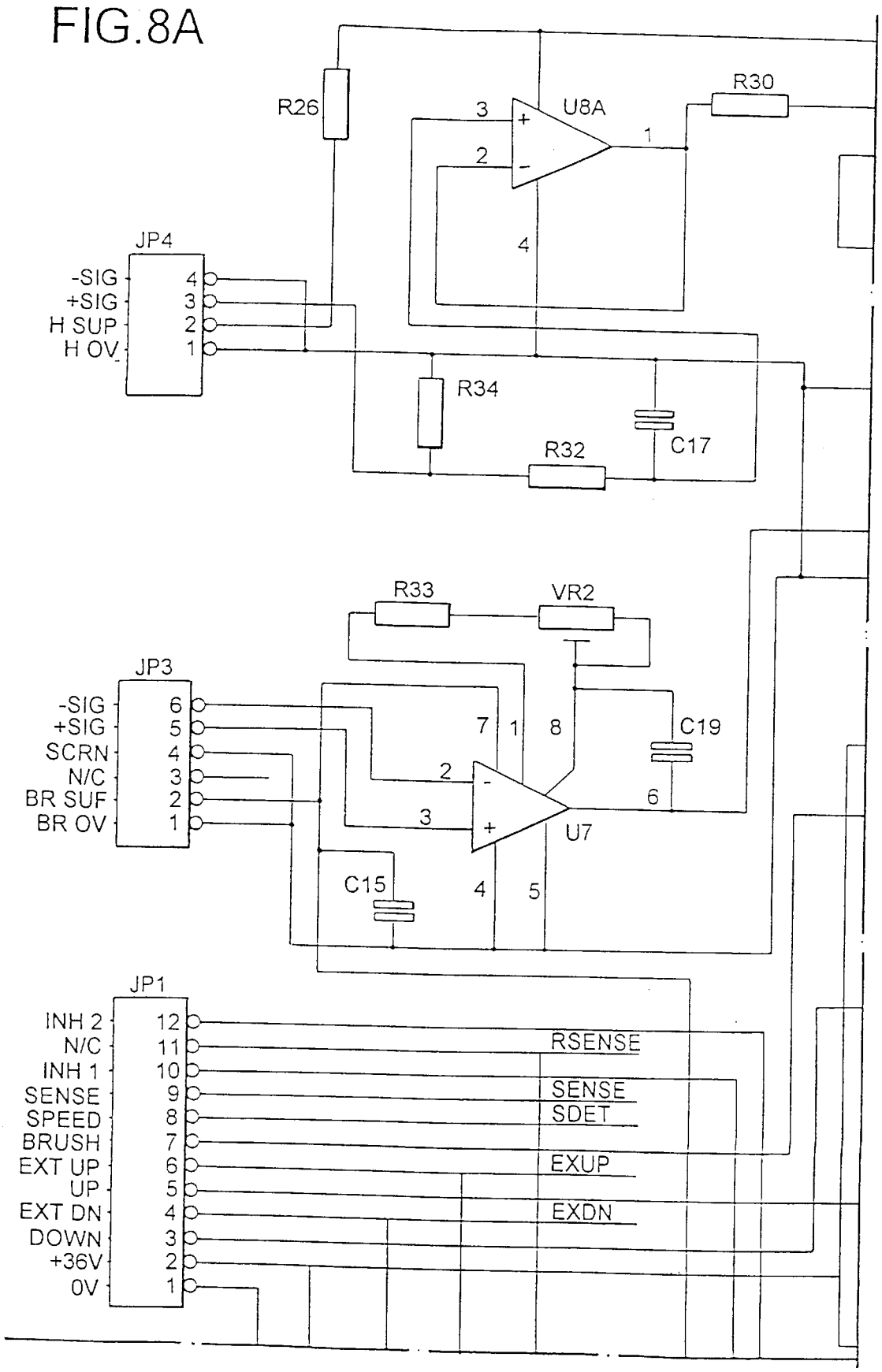
FIGS. 8*a*–8*h* comprise a circuit diagram illustrating a further embodiment of control means with the present invention.
Figure 8B:
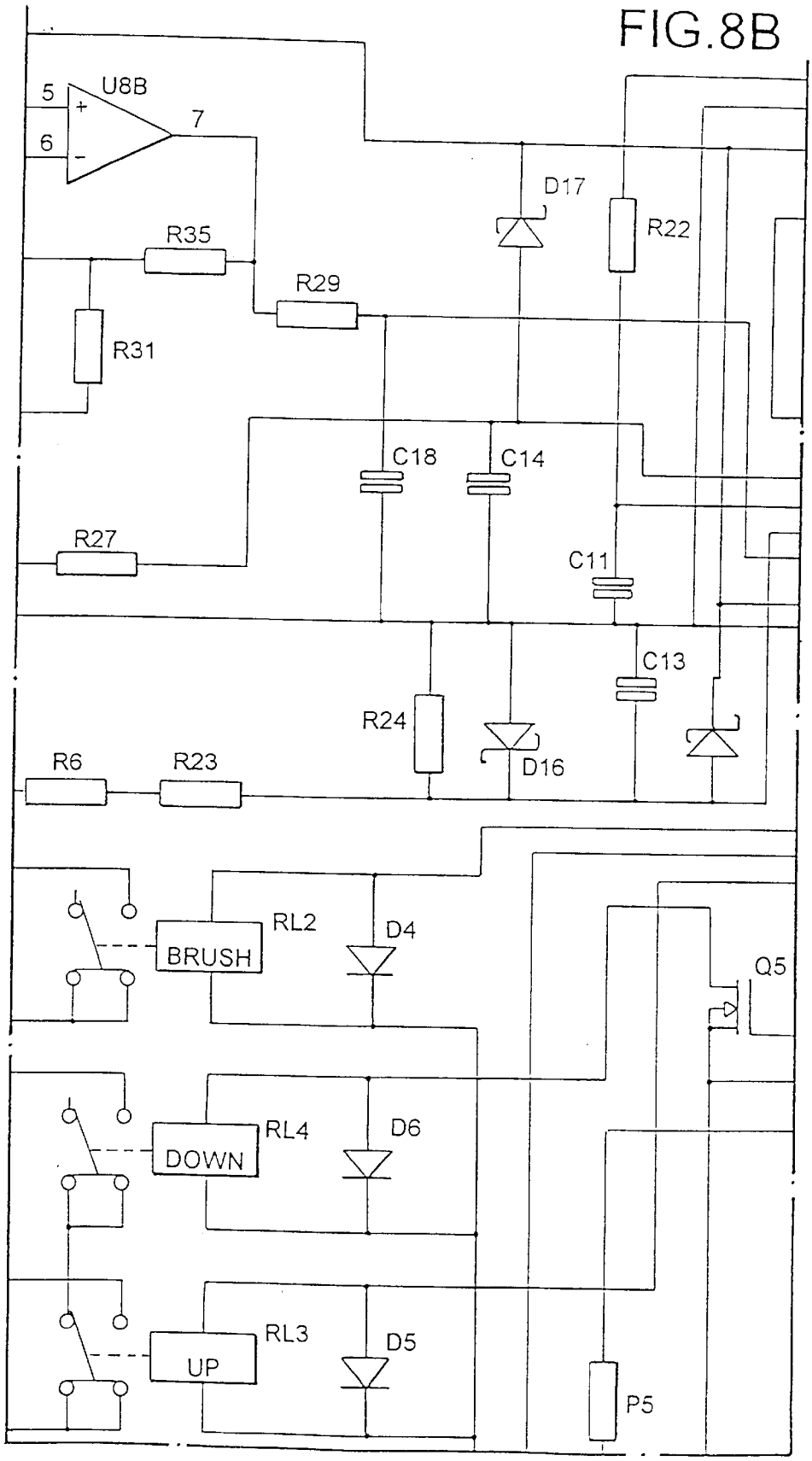
Figure 8C:
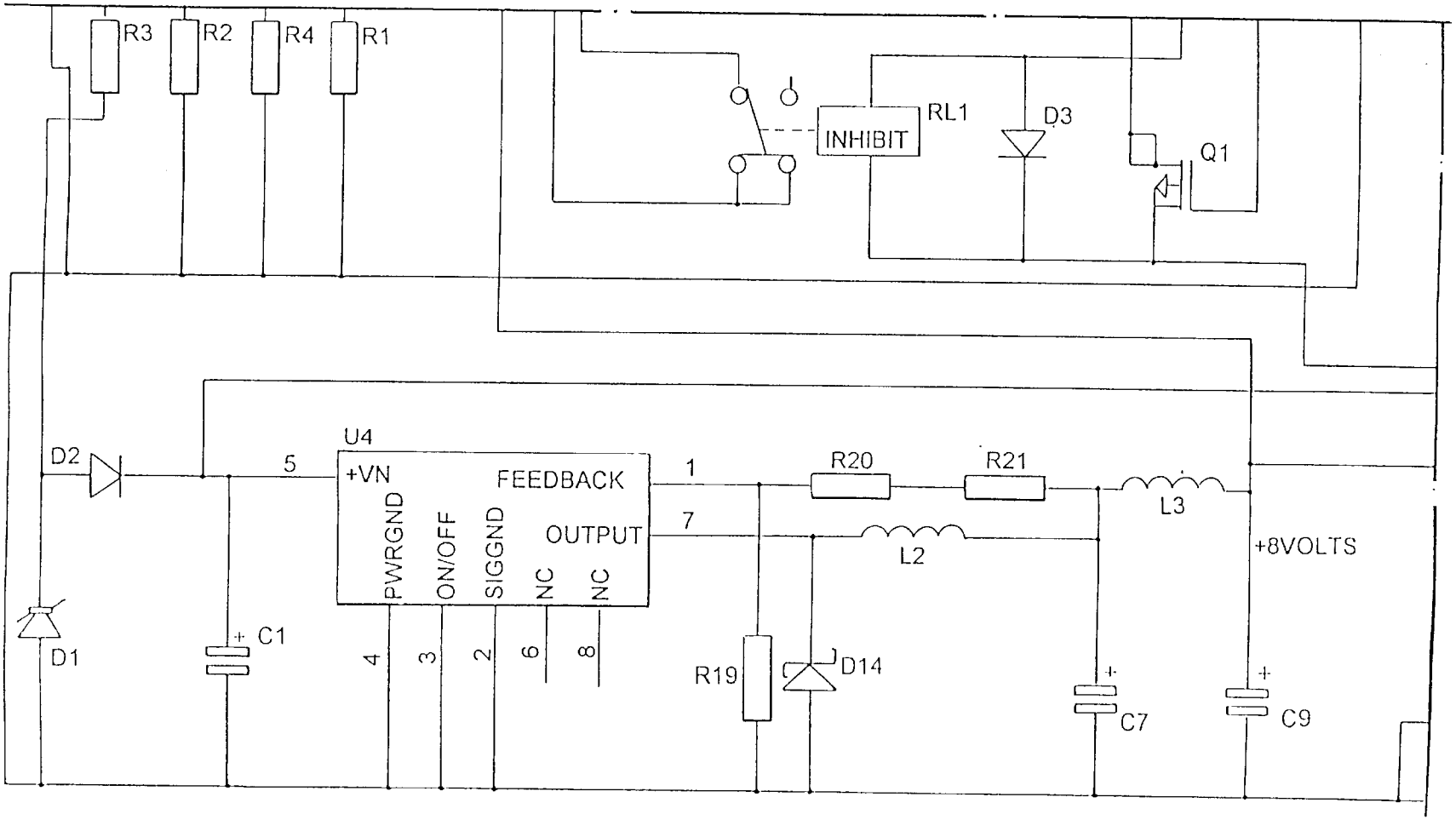
Figure 8D:
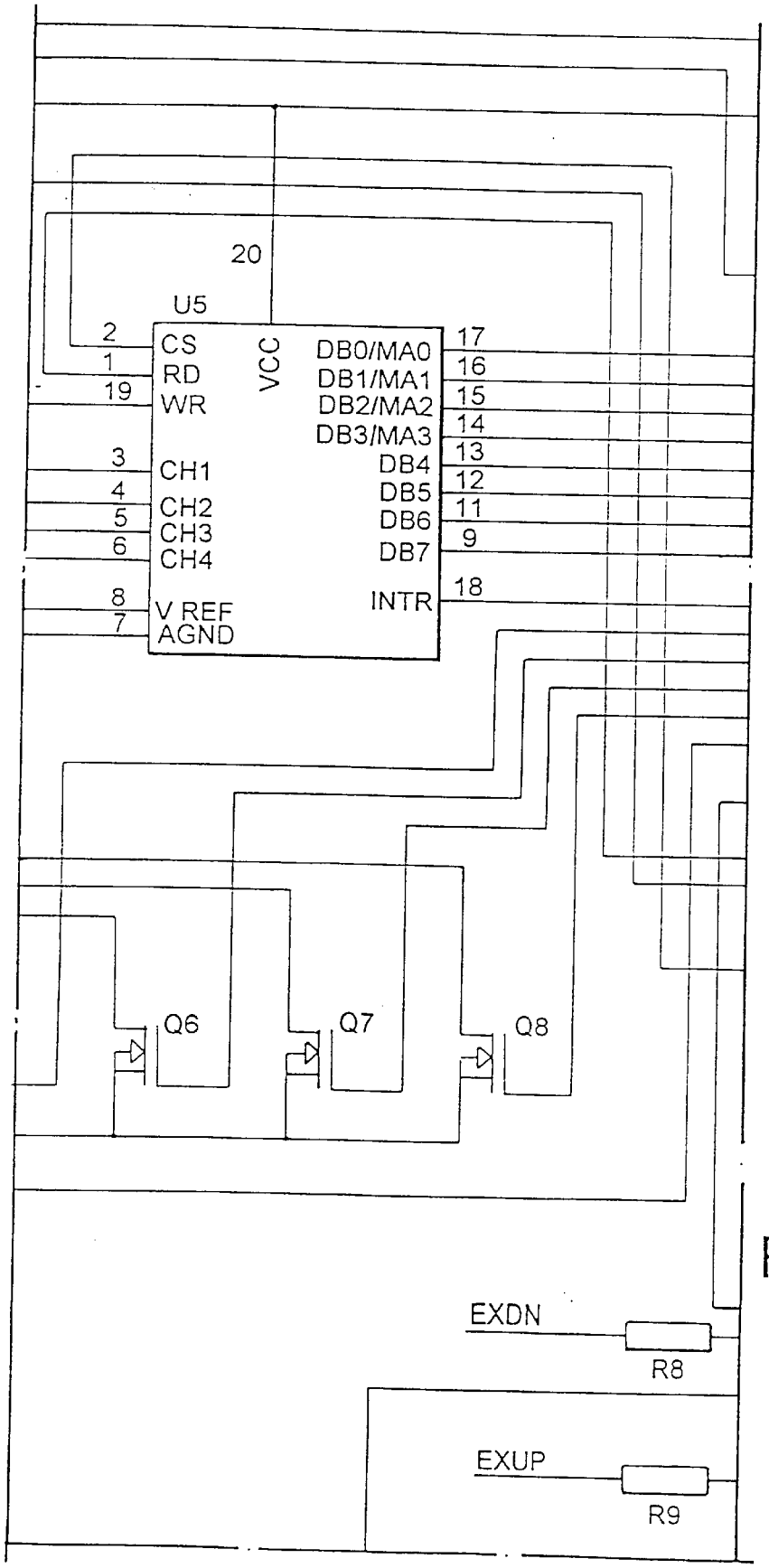
Figure 8E:
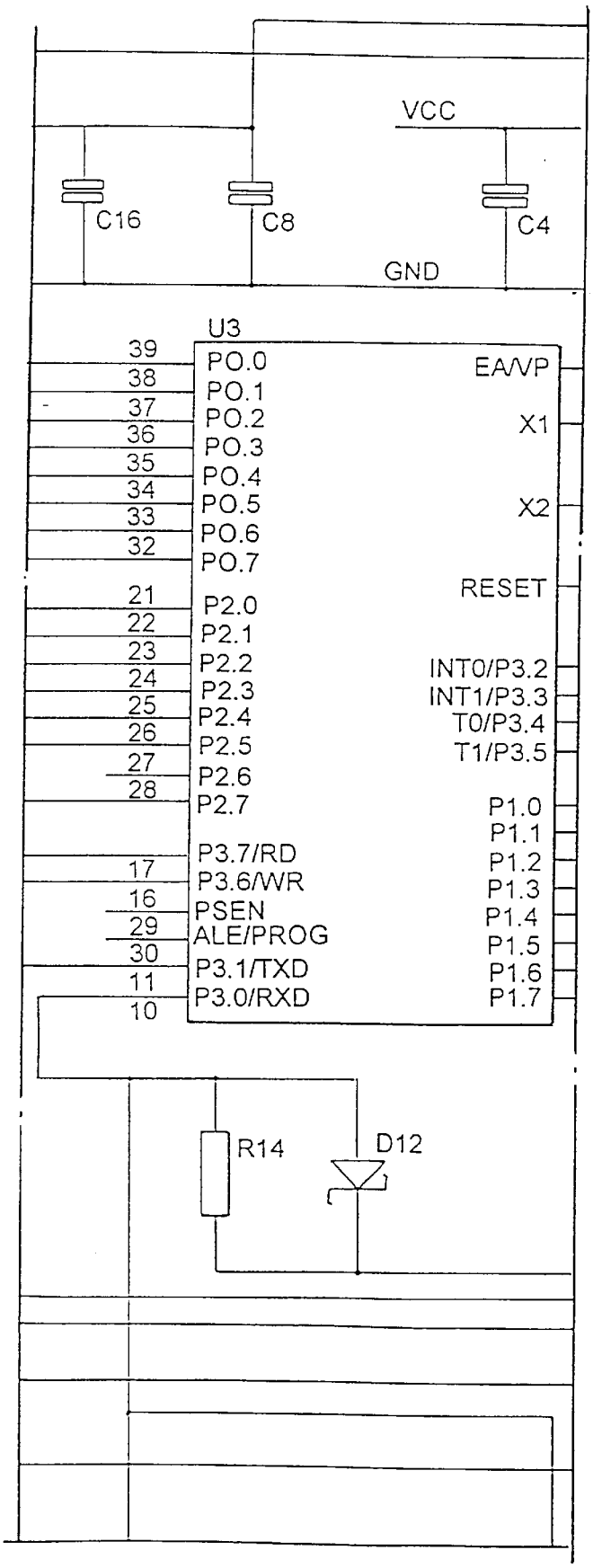
Figure 8F:
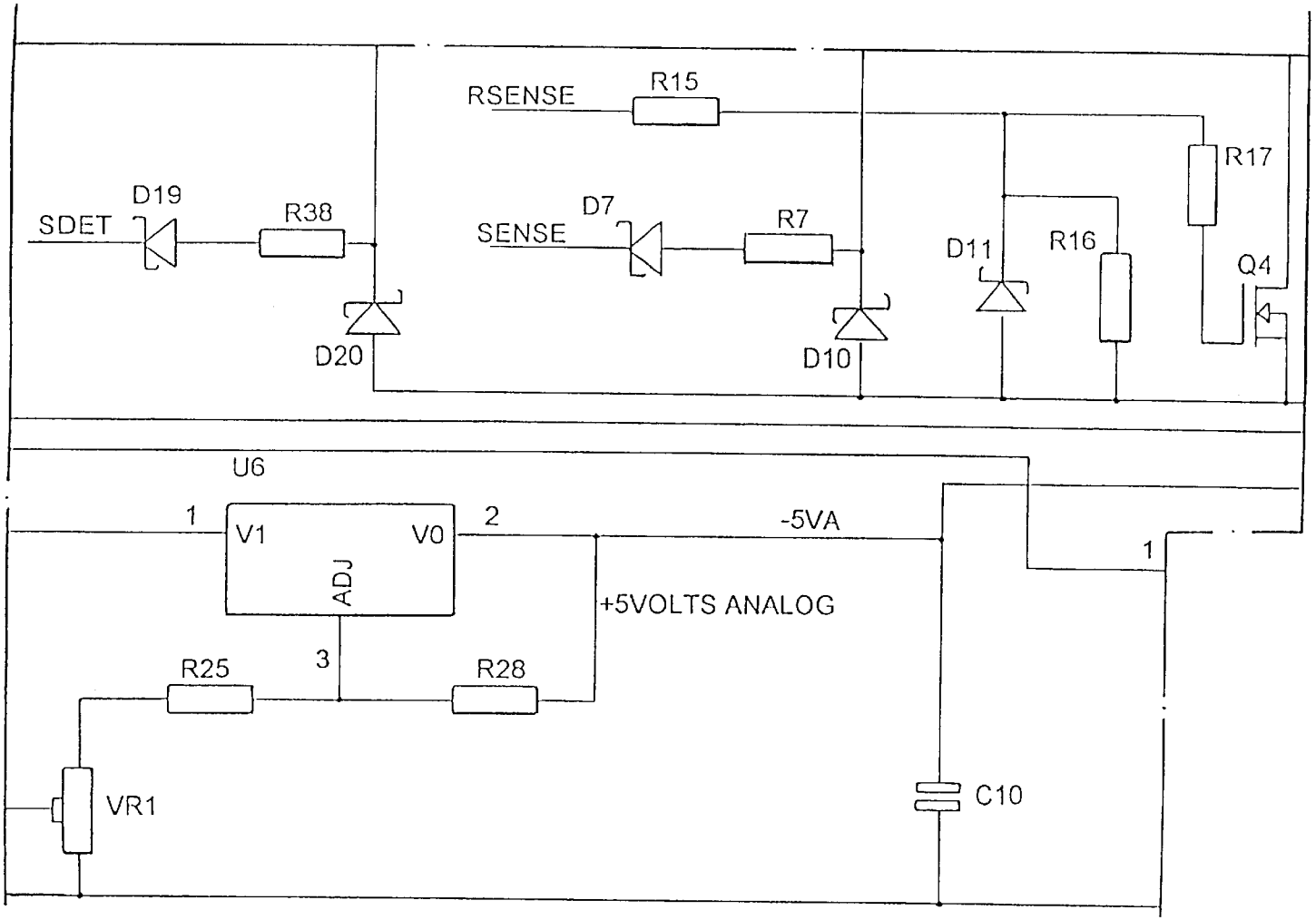
Figure 8G:
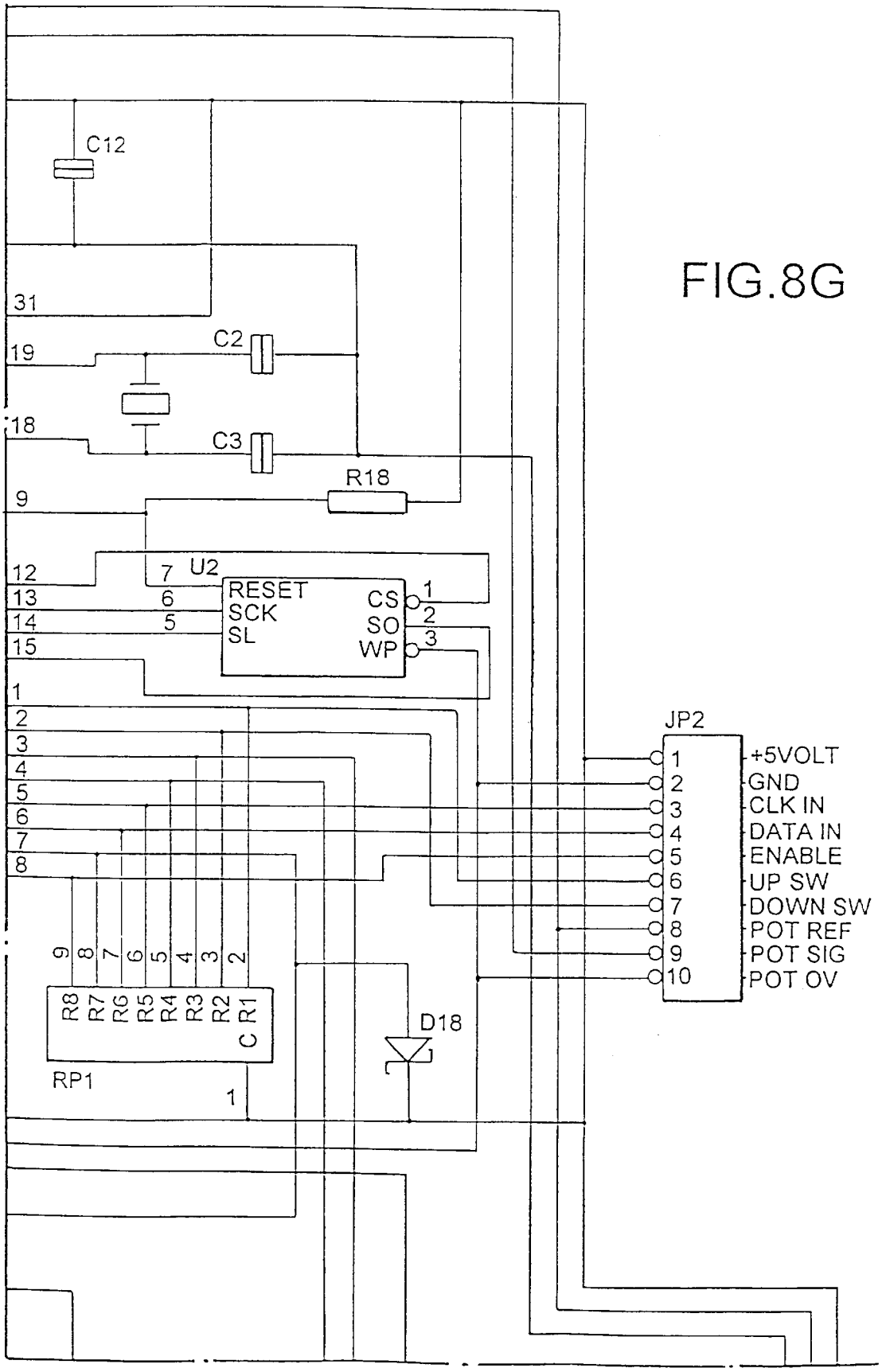
Figure 8H:
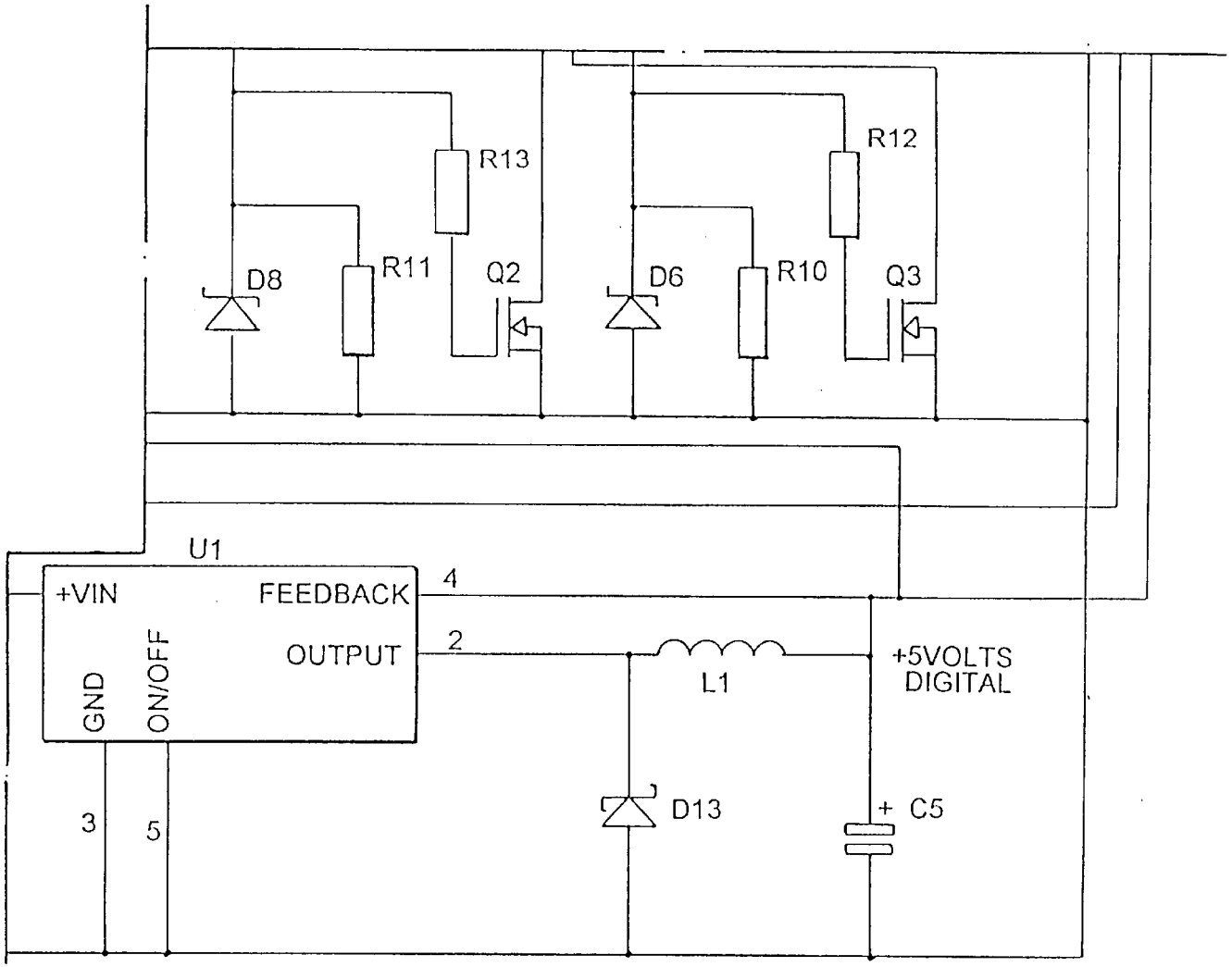

Turning now to FIGS. 5, 6 and 7, where features corresponding to those in FIG. 4 have the same reference numerals, there is shown a balance beam 32 is mounted by pivot bearing 33 to one end of a pivot support 34, the other end of which is connected to the frame. The beam 32 is also connected to actuator arm 1 and on the other side of the pivot bearing 33 to a counterbalance means in the form of a gas strut 35, 37 to counterbalance the weight of the brush head. The opposite end of beam 32 is linked to the brush head by a turnbuckle linkage adjuster 36, which is used to adjust the counterbalance for brushes of different length, for example to prevent jamming of the brushes against the floor.

A potentiometer for measuring brush wear is connected between the balance beam 32 and the pivot support 34.

Further support for the brush head is provided by a parallelogram linkage 38 between the brush head and the side of the main frame to keep the brush deck positioned.

A drive wheel 39 for the machine is shown: usually one such wheel is positioned at each corner of the chassis or frame.

The path of movement of the counterweight is shown by arrow A, as the brushes are raised by the lower line and as they are lowered by the upper line. 7 s the brushes are lowered to the floor by the actuator 10 the balance beam 32 rotates about pivot bearing 33 serving to compress the gas strut arrangement 35, 37, The brush head is lowered to the floor by the extension of the actuator 1. However as the brush head 8 approaches the floor, the pressure to be exerted by the brush head 8 on the floor is advantageously counterbalanced by the gas strut means 35, 37. This counterbalancing action is achieved by the compression of the gas strut arrangement 35, 37 which, having a sealed volume within the chamber 35, limits the degree to which the piston member 37 is slidable with in the chamber 35 and, advantageously, in a resilient manner. Thus, the relative movement between the piston member 37 and the chamber 35 advantageously allows for the exertion of an accurately determinable low pressure at the brush head 8 since the limiting, and thus counterbalancing, effect of the gas strut arrangement 35, 37 serves to effectively reduce the pressure applied by way of the actuator 1, and through the brush head 8, to the floor.

When the force exerted by the actuator 1 on the brush head 8 is removed, i.e. the actuator 1 is retracted so as to raise the brush head 8, the compressed pressure within the chamber 35 is relieved and the gas strut arrangement 35, 37 extends and the volume of fluid introduced into the chamber 35 is chosen such that the extended gas strut arrangement 35, 37 can readily support the brush head 8 in such a raised position.

It will be appreciated that, by acting as a counterbalancing force, the gas strut arrangement 35, 37 serves to offer support for the weight of the brush head 8 and allows the net force exerted by way of the actuator 1 through the brush head 8 onto the floor to be accurately controlled particularly in the range of zero pressure to pressure corresponding to the weight of the brush head arrangement 8.

FIG. 6 is a side view of another embodiment of the present invention in which the features common to FIG. 5 are provided with the same reference numerals.

The counterbalance arrangement illustrated in FIG. 6 operates in a similar manner to that illustrated with reference to FIG. 5 in that, as the brush head 8 is lowered towards the floor by means of the actuator 1, the gas strut arrangement, 35*a*, 37*a* is compressed.

As will be appreciated from FIG. 6, the device includes a shorter parallelogram arrangement 38*a* and found in FIG. 5, and the gas strut arrangement 35*a*, 37*a* is operatively connected between a frame portion of the sweeping/cleaning machine and the brush head 8 by means of its connection to the lower strut of the parallelogram arrangement 38*a*. As will be appreciated, as the brush head 8 is moved towards contact with the floor surface to be swept or cleaned, the parallelogram arrangement 38*a* pivots in a clockwise manner serving lo move the piston member 37*a* into the chamber 35*a* of the gas strut arrangement and which relative movement is gradually resisted by the pressure developed within the chamber 35*a*. The counterbalancing force offered by the gas strut arrangement 35*a*, 37*a* shown in FIG. 6 serves, as with the arrangement illustrated in FIG. 4, to provide a net force at the brush head 8 which can readily be controlled particularly in the range zero pressure to a pressure corresponding to the weight of the brush head 8.

Turning now to FIG. 7, yet another embodiment of the present invention is illustrated and in which the features common to FIGS. 4 and 5 have been given similar reference numerals.

The main difference between the embodiment of FIG. 7 and the embodiments of FIGS. 5 and 6 is that the required net force exerted by the brushes 27 of the brush head arrangement 8 on the ground is achieved when the gas strut arrangement 35*b*, 37*b* is extended rather than compressed. Again, it is the pressure within the chamber 35*b* that limits the extent to which the piston member 37*b* can be extended therefrom and this serves to counterbalance the force exerted by way of the actuator 1. The gas, strut arrangement 35*b*, 37*b* of the embodiment of FIG. 7 is operatively connected between an extension bracket 401 of the frame 30 of the cleaning machine and a connection lug 411 of the brush head arrangement 8. As will be appreciated from FIG. 7, as the actuator is operated so as to lower the brush head arrangement towards the ground to be swept/cleaned, the gas strut arrangement 35*b*, 37*b* is extended and effectively becomes tensioned in view of the pressure developed within the chamber 35*b*. In reverse when the brush head arrangement 8 is raised from the floor, the pressure developed within the chamber 35*b* by the previous relative movement between the chamber 35*b* and the piston member 37*b* serves to assist with supporting the weight of the brush head arrangement 8 clear of the floor.

As with each of the embodiments described herein, the gas strut arrangement can advantageously be provided in a manner such that the pressure within the chamber thereof can be selectively varied to any particular value when the brush pressure arrangement is at rest, i.e. when the brush head arrangement 8 is raised from the floor.

The circuit of FIG. 8 can be used as the control system for the system and provides for an advantageous arrangement for achieving accurate control of the pressure and speeds required of the present invention. It comprises standard integrated circuits including a programmed micro controller or micro-processor U3, power supply IC's U1, U4 and U6, non-volatile memory store U2, and analogue to digital converter U5.

A measured pressure signal front a pressure bridge or strain gauge mounted in the cleaning head is input to the microprocessor U3 via instrumentation amplifier U7 and analogue to digital converter (ADC) U5.

System variables are stored in the non-volatile memory tore U2.

The state of external switch inputs on the cleaning machine are sampled via buffer JP2.

The microprocessor U3 makes appropriate calculations based on the sampled values and the set system variables and outputs control signals via mosfets Q5 to Q8, relays RL1, RL2, RL3, and RL4 and buffer JP1 to contact relays to operate the actuator on the cleaning machine itself. For example, when relay RL4 is tripped 36 volts are applied to the cleaning head lowering actuator, when relay RL3 is tripped 36 volts are applied to raise the cleaning head, and when relay RL1 is tripped the drive control or traction of the cleaning machine is inhibited. When relay RL2 is activated, the brush motor solenoid is switched on. This is programmed to occur only when the actual brush pressure and the desired brush pressure are balanced and also only when the machine is in motion to prevent the brushes marking the floors whilst stationary.

The SENSE input on buffer JP1 senses whether or not the cleaning machine is moving. If it is, then the circuit inhibits pressure changes to avoid damaging the brushes.

The SPEED input on buffer JP1 senses whether the brushes have been selected for high or low speed. This information is passed to processor U3 which limits the brush pressure at high speed to a pre-determined range to protect the brush motors.

Buffers JP2 supplies signals to the machine control panel to display the actual measured pressure indication and the set value indication respectively an LED displays.

Further modifications can be included in this circuit, for example a battery monitor could advantageously be incorporated to record the total usage time and monitor the charge state of the battery. Under certain predetermined conditions, as programmed Into the system parameter memory circuit U2, the cleaning brushes would be automatically raised. Such conditions would typically be long battery usage and/or low battery charge. The operator would then necessarily have to take the machine back to the depot to recharge or replace the battery thus preserving the warranty on the battery.

The control circuit of the invention is very finely tunable and achieves extremely accurate pressure settings for the brush head.

The micro-controller U3 is preferably programmed to always effect pressure changes in a direction such that the brushes are moved downwardly and this aids the accuracy of the settings. For example, if a change in pressure from 100 lbs to 40 lbs is required by an operator, the controller will cause a jump to a value around 20 lbs and then slowly increase the pressure up to the required value of around 40 lbs. This arrangement overcomes stiction in the machine. It is particularly advantageous if phase advance calculations are also used by the micro-controller such that the micro controller calculates the speed at which the pressure changes are occurring and makes appropriate adjustments.

The circuit also preferably monitors the state of the external brush head raise/lower switch and the microprocessor U3 can be programmed to take the state of this switch into account in making decisions on whether to effect certain operations.

Figure 9:
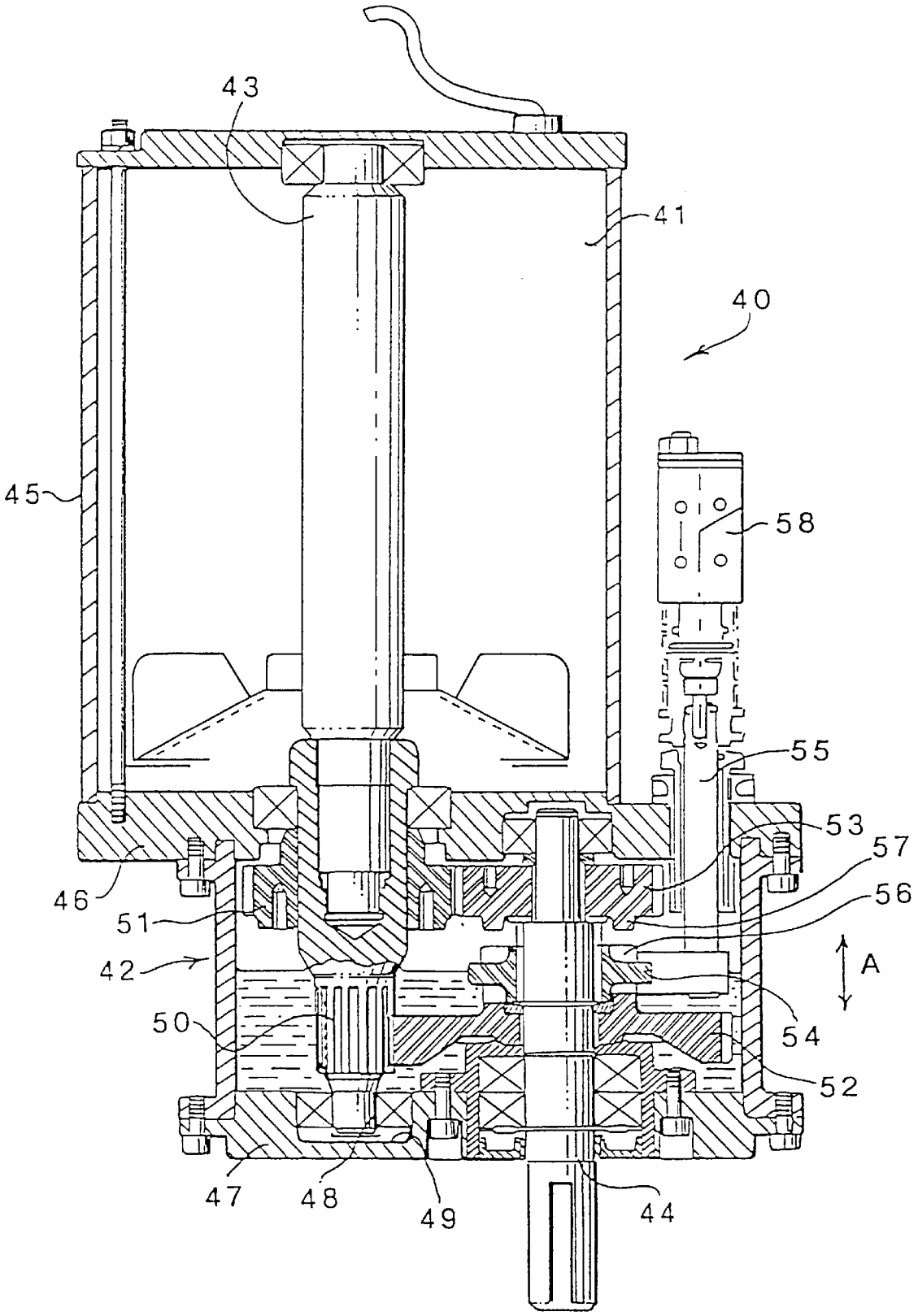
FIG. 9 is a cross-sectional view through a selectively operable gearing arrangement for use in selecting the speed at which the working-head means of the present invention is driven.

FIG. 9 shows a cross-section through a working-head driving arrangement 40 according to one embodiment of the present invention and which comprises a motor 41 in association with a gearbox 42.

A drive shaft 43 within the motor provides for the rotational input gearbox 42, and an output shaft 44 extending from the gearbox 42 provides for a driving output of the arrangement to the rotatable cleaning/burnishing head of the apparatus.

The motor comprises a housing 45 which extends in a direction parallel to the motor shaft 43 and a motor closure plate 46 is provided at the end of the motor housing 45 adjacent the gearbox 42. Indeed, the gearbox is mounted by way of bolt means to the motor closure plate 46 and so that the output shaft 44 of the gearbox 42 extends parallel to the longitudinal axis of the motor shaft 43.

The gearbox 12 includes a housing which extends from the motor closure plate 46 and which is closed, at its end remote from the motor closure 46, by a gearbox closure plate 47 through which the output shaft 44 extends.

The input shaft 43 engages with a stub shaft 48 which extends into the gearbox 42 and which is rotatably secured, at its end remote from its engagement with the input shaft 43, in a locating recess 49 provided in the inner surface of the gearbox closure plate 47. The locating recess 49 provides for rotatable mounting of the stub shaft 48 within the gearbox.

The stub shaft 48 is provided with two gears along its axial length. A first gear 50 is provided at the end of the stub shaft 48 adjacent co the recess 49 and this first gear 50 has a diameter slightly less than the stub shaft 48. A second gear 51 located on the stub shaft 48 and adjacent to the motor closure plate 46 has a diameter greater than the stub shaft 48.

As will be explained later, the first 50 and second 51 gears provided on the stub shaft 48 are arranged to provide predetermined gear ratio within the gear arrangement of the gearbox 42.

The output shaft 44 is rotatably mounted within the gearbox and, as will be appreciated, extends between respective bearing sets located adjacent to the motor closure plate 46 and the gearbox closure plate 47.

As with the stub shaft 48, the output shaft 44 includes two gears spaced along the axial direction of the output shaft 44 such that one of the gears 52 is arranged to mesh with the first gear 50 on the stub shaft 48 and the other of the gears 53 is arranged to mesh with the second gear 51 provided on the stub shaft 48.

The gear 53 provided on the output shaft 44 is arranged to have a diameter which is the same as that of the second gear 51 on the stub shaft 48 such that the gear ratio between the gears 51 and 54 is 1:1.

The gear 52 provided on the upward shaft 44 has a larger diameter than the gear 50 provides on the stub shaft 48, and indeed the gears 51, 54.

The gear 52 is chosen such that the gear ratio between the gears 50 and 51 is 5:1.

The aforementioned gear ratios provide for the speed reduction required when switching between a floor scrubbing and floor burnishing operation arid so the gearbox of FIG. 9 provides for an effective two-speed gearbox. As will be appreciated, when the gear pair 51, 54 provide for rotation of the output shaft 44, the output shaft rotates at a speed consistent with the speed of the motor, for example 1,000 rpm. However, when the gearbox 4 s switched so that the gear pair 50, 52 drive the output shaft 44, the gear ratio 5:1 of this gear pair determines that the speed of the output shaft, and thus the drive to the surface-working head member, is reduced to 200 rpm.

The aforementioned respective speeds are those preferred for scrubbing and burnishing operations and so, along with an appropriate control of the pressure at which the surface-working head member is applied to the surface, scrubbing and burnishing operations can be provided by the apparatus.

As will further be appreciated from FIG. 6, the gear pairs 51, 53 and 50, 52 are moutnted in constant mesh and the gears 52, 53 on the output shaft are arranged to be free running during operation of the motor and to selectively control the drive of the output shaft 44 by means of a dog-clutch 54.

The dog-clutch 54 is driven by means of an actuator 55 in a reciprocal manner in the direction of arrows A so as to either engage with a face of the gear 52 or a face of the gear 53. The dog-clutch 54 is provided with opposite facing surfaces including gearing recesses 56 which are arranged to receive gear stubs 57 formed on the aforementioned faces of the gears 52, 53.

In its position as Illustrated in FIG. 6 the dog-clutch 54 is moving into engagement with the gear stubs of the gear 52 so as to provide for a rotational drive to the surface-working head member at a speed of 200 rpm.

The actuator 55 is driven by way 7 of a gear-change actuator assembly which can advantageously be solenoid driven and which can further include solenoid locking means so as to advantageously prevent movement of the dog-clutch once a particular speed rotation of the output shaft 44 has been selected.

As mentioned previously, the gear-change actuator assembly 58 can be advantageously associated with control means whereby the selection of a particular pressure to be applied by way of the surface-working head arrangement serves to actuate the gear-change assembly 58 to select the particular gear ratio, or alternatively, a selection of a particular gear ratio serves to effect, or limit, the pressure applied by way of the selective pressure exertion means in response to the gear ratio selected.

It will be appreciated that the present invention is not restricted to the details of the foregoing embodiments. For example, any appropriate means for selecting the pressure applied by way of the surface-working head arrangement can be incorporated within the present invention as indeed can any appropriate form of speed-selection means. Further, the apparatus can be readily incorporated in a ride-on machine in addition to the pedestrian machine illustrated herein.

I claim:

1. Surface working apparatus comprising a machine frame supporting a surface-working head arrangement driven by a motor, means for selectively varying the pressure exerted by said head arrangement on said surface, means for selectively varying the speed at which said head arrangement is driven by said motor, an actuator arrangement for raising and lowering the surface-working head arrangement and mounted between the frame and the surface-working head arrangement, and means operatively connected to the surface-working head arrangement and arranged to at least partially counteract the force to be exerted on the surface by way of the surface-working head arrangement and so as to control the pressure exerted by the surface-working head arrangement on the surface to a range which includes zero pressure to a pressure corresponding to the weight of the surface-working head arrangement.

2. Apparatus as claimed in claim 1, wherein the means for counteracting the force exerted on the surface-working head arrangement comprises counterbalancing means.

3. Apparatus as claimed in claim 1, wherein the means for counteracting the force exerted on the surface-working head arrangement comprises resilient means operatively connected to the surface-working head arrangement.

4. Apparatus as claimed in claim 1, wherein the resilience of the resilient means is selectively variable.

5. Apparatus as claimed in claim 3, wherein the resilient means comprises at lease two relatively moveable members and arranged to be relatively movable in a resilient manner.

6. Apparatus as claimed in claim 3, wherein the resilient means comprises a cylinder and piston arrangement.

7. Apparatus as claimed in claim 6, wherein the resilient means comprises a gas strut arrangement.

8. Apparatus as claimed in claim 3, wherein the resilient means comprises spring means.

9. Surface working apparatus comprising a machine frame supporting a surface-working head arrangement driven by a motor, means for selectively varying the pressure exerted by said head arrangement on said surface, means for selectively varying the speed at which said head arrangement is driven by said motor, and wherein the means for selectively varying the speed at which the head arrangement is driven by said motor comprises a selective plurality of gear arrangements having gear ratios determined on the basis of the working-operations required.

10. Apparatus as claimed in claim 9, wherein the plurality of gear arrangements is located in a gearbox between the motor and the surface-working head arrangement.

11. Apparatus as claimed in claim 10, wherein the plurality of gear arrangements comprises respective pairs of gears in constant mesh, and means for selecting one of said pairs for delivering the upward drive from said gearbox.

12. Apparatus as claimed in claim 11, wherein the means for selecting said one of said pairs comprises clutch means in the form of dog-clutch means.

13. Apparatus as claimed in claim 12, including control means comprising a solenoid actuator arranged to be retained in its two or more possible operative positions by solenoid locking means.

14. Apparatus as claimed in claim 10, having means for controlling switching in the gearbox which is associated with the means for selectively varying the pressure applied by way of the surface-working head arrangement so that the switching of the gearbox is achieved in response to the selection of particular pressure values either above or below one or more threshold values or the selection of specific values.

15. Apparatus as claimed in claim 10, having a control arrangement arranged such that the selection of any particular pressure value or range is responsive to switching of the gearbox.

16. Apparatus as claimed in claim 9, wherein the plurality of gear arrangement advantageously comprises a first gear pair with a 1:1 ratio and a second gear pair with a 5:1 ratio.

17. Apparatus as claimed in claim 9, and including control means for inhibiting the change in gearing while the motor is driving the surface-working head arrangement.

18. Apparatus as claimed in claim, 17, wherein the control means is arranged to limit the pressure that can be applied by the surface-working head arrangement once the high-speed gear ratio is selected.

* * * * *